US005265301A

United States Patent [19]

Irwin

[11] Patent Number: 5,265,301

[45] Date of Patent: Nov. 30, 1993

[54] DRAIN CLEANING APPARATUS

[76] Inventor: Lawrence F. Irwin, 12860 San Fernando Rd., Sylmar, Calif. 91342

[21] Appl. No.: 970,097

[22] Filed: Nov. 2, 1992

[51] Int. Cl.[5] ..... B08B 9/02

[52] U.S. Cl. ..... 15/104.33

[58] Field of Search ..... 15/104.33

[56] References Cited

U.S. PATENT DOCUMENTS

| | | | |
|---|---|---|---|
| 2,470,225 | 5/1949 | Silverman | 15/104.33 |
| 2,661,489 | 12/1953 | Rudolph et al. | 15/104.33 |
| 2,926,372 | 3/1960 | O'Brien | 15/104.33 |
| 3,691,583 | 9/1972 | Silverman et al. | 15/104.33 |
| 4,104,757 | 8/1978 | Silverman et al. | 15/104.33 |
| 4,247,630 | 9/1981 | Perez | 15/104.33 |
| 4,317,247 | 3/1982 | Levine | 15/104.33 |
| 4,340,988 | 7/1982 | Shames | 15/104.33 |
| 4,364,139 | 12/1982 | Babb et al. | 15/104.33 |
| 4,617,693 | 10/1986 | Meyer et al. | 15/104.33 |
| 4,706,321 | 11/1987 | Kaye | 15/104.33 |

*Primary Examiner*—Edward L. Roberts
*Attorney, Agent, or Firm*—J. E. Brunton

[57] ABSTRACT

A drain cleaning device of the type that includes an elongated, flexible coil spring or plumbers snake formed of helically wound spring wire which can be controllably withdrawn from the device for insertion into the pipe to be cleaned. The device is provided with a novel storage reel or drum drive arrangement which includes a friction clutch mechanism that automatically disengages the drum drive mechanism from the drum so as to stop rotation of the drum prior to any excessive torque build up within the snake. The clutch mechanism is adjustably spring loaded so that the device can be easily adjusted for optimum use with springs of different diameters and rigidity. The storage container or drum can be rotated either by hand or by a motorized tool at relatively high speeds for long periods of time without excessive buildup within the plastic components of the device due to frictional engagement among the rotating parts of the device.

15 Claims, 5 Drawing Sheets

DRAIN CLEANING APPARATUS

BACKGROUND OF THE INVENTION

1. Field of the Invention

This invention relates generally to drain cleaning devices. More particularly the invention concerns a drain cleaning apparatus for controllably feeding a flexible plumbers snake into a drain line.

2. Description of the Prior Art

A number of different types of devices have been suggested in the past for clearing drain and sewer lines of obstructions. Over the years the construction of these devices has become standardized in many respects. For example, such devices typically include a closed drum, or reel, from which a length of plumbers snake (coiled spring) is paid out. After coming off the reel, the snake is guided into a forwardly disposed guide neck which is substantially in alignment with the axis of the reel. If the snake is not to be paid out by hand, the guide neck is usually provided with snake engagement means which engage the snake so that upon rotation of the drum, or reel, rectilinear movement is imparted to the snake. Thus, if the reel is rotated either direction, the snake can be paid out or taken in.

One of the most commonly used forms of plumber's snake consists of a helically coiled wire. Such snakes are manufactured in several diameters, common sizes being ¼", 5/16" and ⅜" in diameter. These sizes enable the plumber to cope with stoppages in the various-sized waste pipes usually encountered where hand-held tools are used.

In cleaning out a clogged drain or sewer line, the free end of the snake and guide rod are first introduced into the line. Next, rotation of the drum in a forward direction is initiated using either a hand crank or a motorized drive and finally the snake is paid out by bringing the feed means into engagement with the snake so as to controllably feed it into the line or by hand operation. Feeding of the snake is continued until the obstruction is encountered and loosened.

In actual practice, should the snake encounter a blockage within the line which cannot be loosened, the snake may be caught so that it cannot rotate. In this situation continued rotation of the reel, even for a short period, can cause significant build up of torque forces on the snake within the drum or a distortion or kinking can occur in the coiled snake section between the drain opening and it. If feeding is allowed to continue, these torque forces will cause undesirable back-looping and kinking of the snake within or without the storage drum or reel. Also, this back-looping in turn causes the snake to become tangled within the drum or reel so that the snake can sometimes neither be paid out nor taken in. To rectify this situation, the operator must stop the clean-out operation and somehow relieve the torque build up so that the snake can be untangled. This operation can be both dangerous and time consuming and frequently the operator is simply unable to clear the entanglement sufficiently to continue. It is the solution of this problem of torque build up in the snake to which the present invention is directed.

In the past, various arrangements have been suggested to eliminate or minimize the torque build up and back-looping or kinking in motorized sewer clean-out tools. One of the most successful of these was made by the present inventor and is described in U.S. Pat. No. 3,958,293. Other proposed solutions to the problem are described in U.S. Pat. No. 3,095,592 issued to the present inventor and in U.S. Pat. No. 2,769,191 issued to Robert G. Hunt. The Hunt machine embodied an independently rotatable combination torque reaction element and guide tube which extended into the storage reel from the front of the machine and cooperated therewith to guide the spring into and out of the storage reel and to prevent kinking thereof due to torque build up. The apparatus described in the earlier U.S. Pat. No. 3,958,293 issued to the present inventor improved upon the Hunt concept by providing an independently rotatable, uniquely grooved, torque reaction element which extended into the reel and cooperated with the reel to prevent the snake from kinking or back-looping.

The apparatus described in U.S. Pat. No. 3,095,592 overcomes the back-looping and coiled spring tangling problem by controllably guiding the snake into a restricted volume storage portion of the drum through a strategically placed passageway formed by necking down the drum at a location proximate the periphery thereof.

The apparatus of the present invention approaches the torque build up problem in a different way by providing a unique friction clutch arrangement that automatically stops drum rotation prior to an excessive build up of torque in the snake (coiled spring). With this novel construction, the snake can be smoothly withdrawn from its coiled configuration and, due to the novel action of the clutch mechanism, is automatically prevented from back-looping and tangling up within the storage drum of the snake is caught so that it cannot proceed freely inwardly of the drain line.

SUMMARY OF THE INVENTION

It is an object of the invention to provide a new and substantially simplified drain cleaning device of the type that comprises an elongated, flexible coil spring or plumbers snake formed of helically wound spring wire which can be controllably withdrawn from the device for insertion into the pipe to be cleaned.

It is another object of the invention to provide a novel storage reel or drum drive arrangement which includes a friction clutch mechanism that automatically disengages the drum drive mechanism from the drum so as to stop rotation of the drum prior to any excessive torque build up of the snake within the drum or outside the drum. In the preferred form of the invention, the clutch mechanism is adjustably spring loaded so that the device can be easily adjusted for optimum use with springs of different diameters an rigidity.

It is another object to provide a device of the aforementioned character in which the storage container or drum can be rotated either by hand or by a motorized tool such as an electric drill.

It is still another object to provide a device of the type described in the preceding paragraph in which the drum can be rotated at relatively high speeds for long periods of time without excessive build up within the plastic components of the device due to frictional engagement among the rotating parts of the device.

Another object is to provide a machine of the aforementioned character which is light weight, easy and inexpensive to manufacture and yet is extremely durable and reliable.

These and other objects will be apparent from the drawings and the following description.

DESCRIPTION OF ONE FORM OF THE INVENTION

Figure 1:
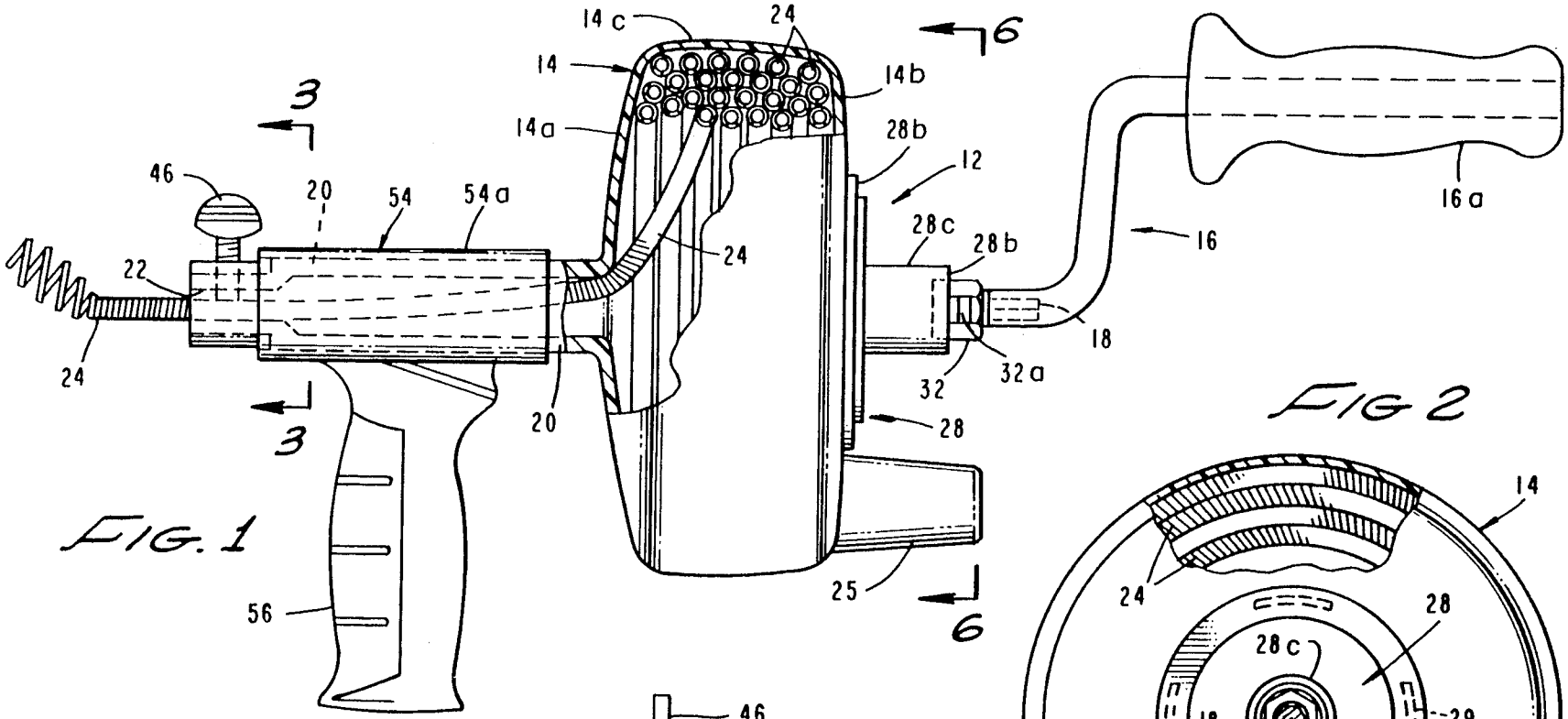
FIG. 1 is a side-elevational view partly in cross section of the improved clean-out tool of the invention.
Figure 2:
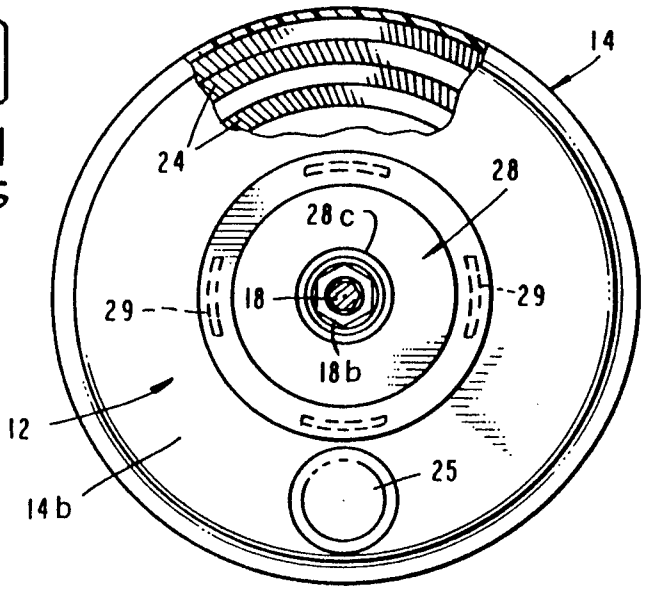
FIG. 2 is a view partly in section taken along lines 2—2 of FIG. 1.
Figure 3:
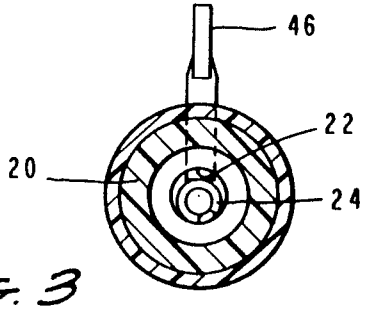
FIG. 3 is a cross-sectional view taken along lines 3—3 of FIG. 1.
Figure 9:
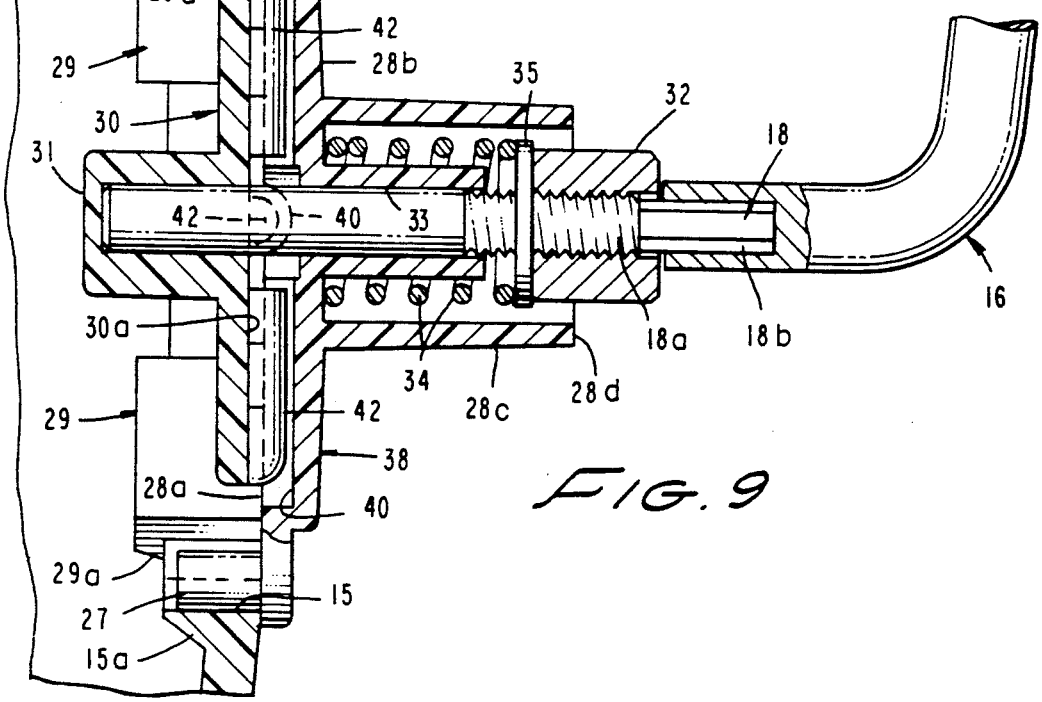
FIG. 9 is a cross-sectional view taken along lines 9—9 of FIG. 7.

Referring to the drawings, and particularly to FIGS. 1, 2 and 3, one form of the drain cleaning machine 12 of the present invention can be seen to include a one piece rotatable drum 14 and drive means for controllably rotating the drum in a forward and reverse direction. In the form of the invention shown in FIG. 1, the drive means comprises a hand crank 16 which is operably connected to a drive shaft 18 (FIG. 9). Drive shaft 18 comprises a part of the drum rotating means of the apparatus, the details of which will presently be described.

Referring particularly to FIGS. 1 and 2, drum 14 comprises a front wall 14*a*, a rear wall 14*b* having a central opening 15 (FIG. 9) and a curved outer peripheral portion 14*c*. Also forming a part of drum 14 is an elongated neck or forward guide portion 20 which is provided with a forward opening 22 (FIG. 15) adapted to accommodate passage of the plumbers snake or coil spring 24 which is normally stored in a coiled configuration within drum 14. Snake 24 is typically formed of helically wound spring wire and is manufactured in various diameters such as ¼, 5/16 and ⅜ of an inch. A gripping knob or protuberance 25 extends rearwardly from rear wall 14*b* of the drain.

Figure 4:
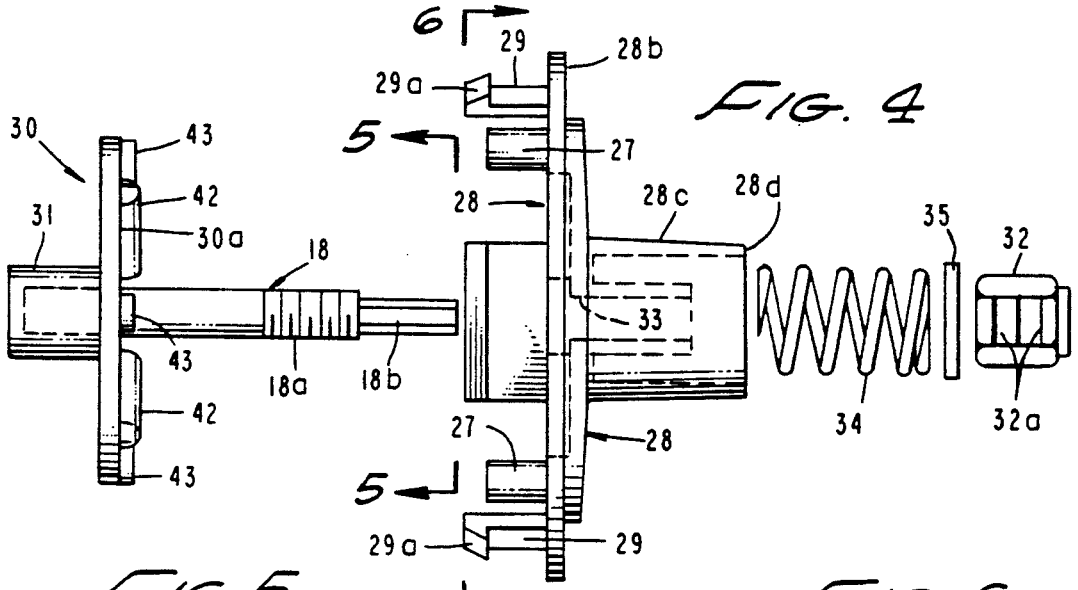
FIG. 4 is an enlarged side-elevational, exploded view of the torque control friction clutch mechanism of the apparatus.
Figure 5:
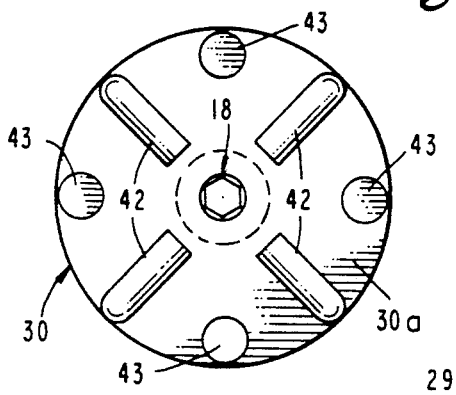
FIG. 5 is a view taken along lines 5—5 of FIG. 4.
Figure 6:
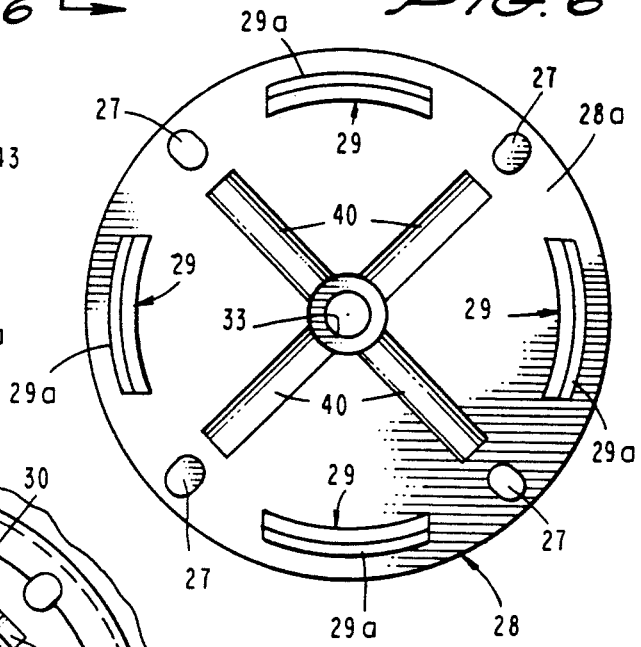
FIG. 6 is a view taken along lines 6—6 of FIG. 4.
Figure 7:
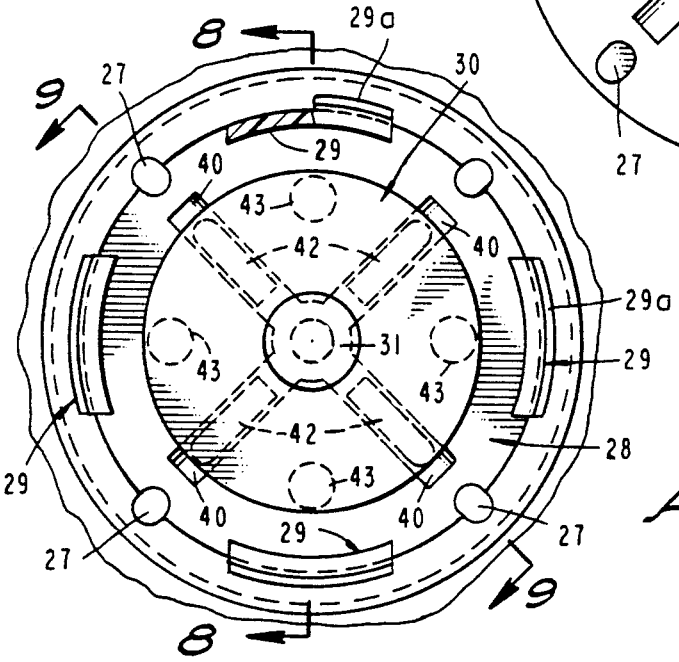
FIG. 7 is a fragmentary enlarged front view of the torque control mechanism in an assembled configuration.
Figure 8:
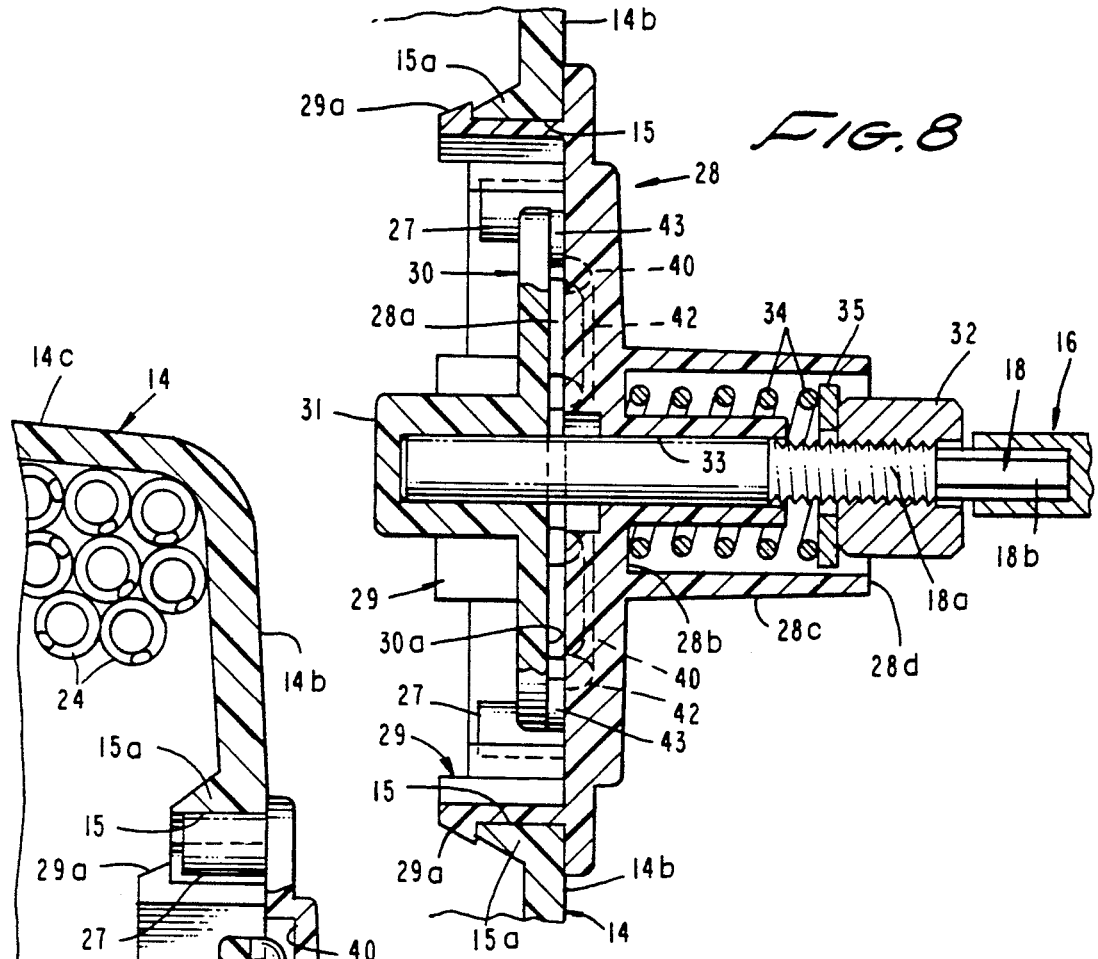
FIG. 8 is a cross-sectional view taken along lines 8—8 of FIG. 7.
Figure 13:
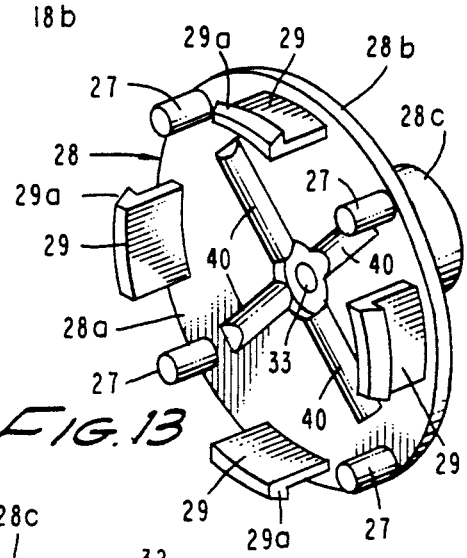
FIG. 13 is a generally perspective view of the second cooperating friction plate assembly of the torque control mechanism.

An important aspect of the present invention is the previously mentioned drum rotating means. This means here comprises a first generally disk-shaped member 28 which removably connected to the rear wall of drum 14 proximate opening 15 provided therein. As best seen in FIGS. 4 and 8, member 28 has circumferentially spaced locking elements 29 and guide protuberances 27 which extend from face 28*a*. Each locking element terminates in a hook like end portion 29*a* which lockably engages the peripheral portion 15*a* of opening 15 provided in rear wall 14*b* of drum 14. Locking elements 29 function to lock member 28 in position within opening 15 in the manner shown in FIG. 4. Disk-shaped member 28 is also provided with a central opening 33 therethrough and inner and outer faces 28*a* and 28*b* respectively (FIGS. 8 and 13). As best seen by referring to FIG. 4, disk-shaped member 28 also includes a centrally disposed, outwardly extending tubular shaped boss 28*c* which terminates in a rearward edge 28*d*.

Also comprising a part of the drum rotating means of the present form of the invention is a second generally disk-shaped member 30 having a face 30*a* disposed proximate inner face or face 28*a* of first disk member 28. Forming a part of second member 30 is the previously identified, outwardly extending drive shaft 18. Drive shaft 18 is connectably received within a hub like protuberance 31 and has an intermediate threaded portion 18*a* and a generally hexagonally shaped end portion 18*b*.

Also forming an important aspect of the present invention is connector means for interconnecting first and second members 28 and 30 and for urging second member 30 into driving engagement with first member 28. The connector means here includes a nut 32 which is threadably inter-connected with threaded portion 18*a* of drive shaft 18 and a coil spring 34 which is disposed between nut 32 and second or outer surface 28*b* of first disk-shaped member 28 (FIG. 10).

The previously identified drive means here shown as crank 16 including a handle portion 16*a* is removably connected to end 18*b* of drive shaft 18 in the manner best seen in FIG. 9. As will presently be described, coil spring 34, which comprises a part of the biasing means of the present invention, functions along with nut 32 to controllably vary the degree of frictional engagement between first disk member 28 and second disk member 30.

Figure 12:
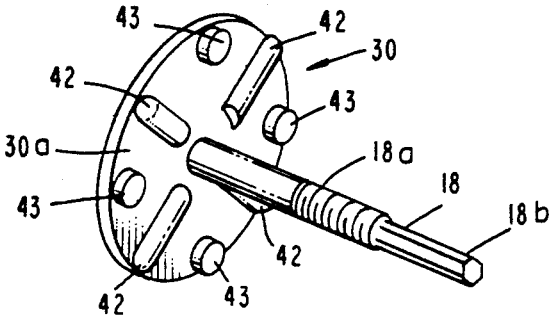
FIG. 12 is a generally perspective view of one of the friction plate and stem assembly of the torque control mechanism.

As best seen by referring to FIGS. 12 and 13, face 28*a* of member 28 is provided with a plurality of recesses 40 which extends radially outwardly from central opening 30. Second member 30 is provided with a plurality of radially outwardly extending protuberances 42 which, in the manner best seen in FIG. 9, are closely receivable within recesses 40 provided in face 28*a* of member 28 when the drum is being rotatably driven.

Figure 10:
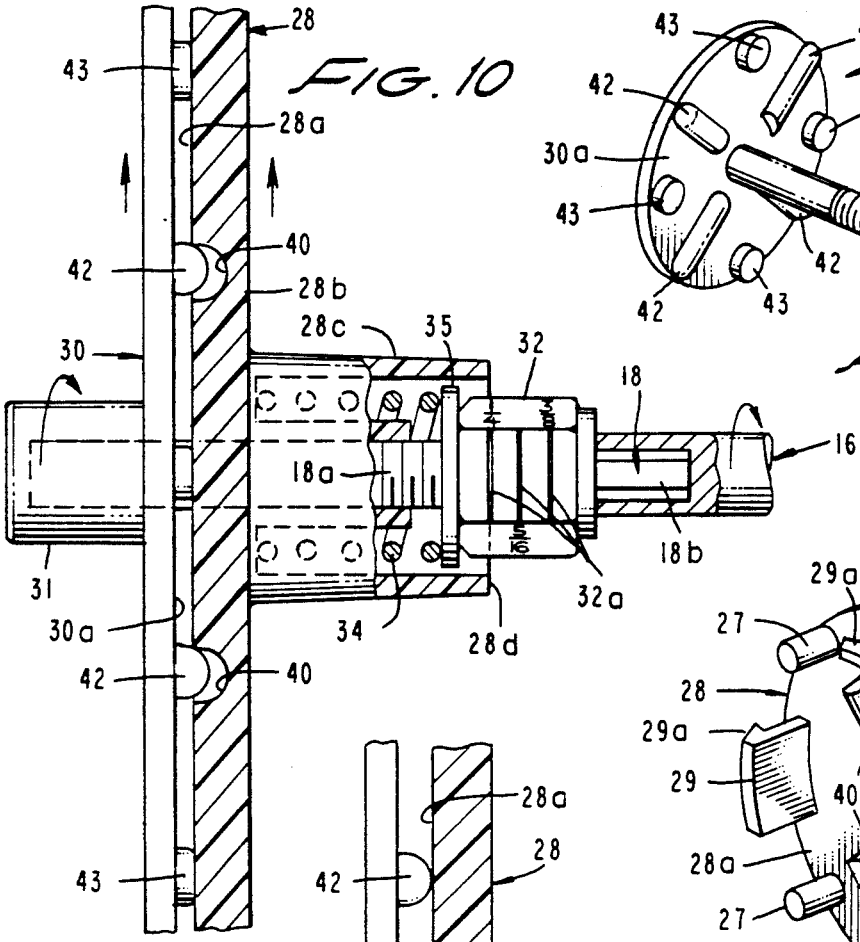
FIG. 10 is an enlarged, side-elevational view partly in section of the torque control mechanism of the apparatus in a first, operable, drum-rotating configuration.

Protuberances 42 are yieldably, maintained within recesses 40 by nut 32 which is acting on compression spring 34 via a washer 35 in the manner shown in FIG. 10. As nut 32 is tightened over threaded portion 18*a* of drive shaft 18, greater compressive forces are exerted on spring 34 tending to urge the protuberances into progressively increasing frictional engagement with recesses 40 provided in face 28*a* of first member 28. Under normal operating conditions, these frictional forces tend to yieldably maintain protuberances 42 in position within recesses 40 so that as crank 16 is turned, member 30 will rotate as will member 28 and drum 14 to which it is connected.

Figure 15:
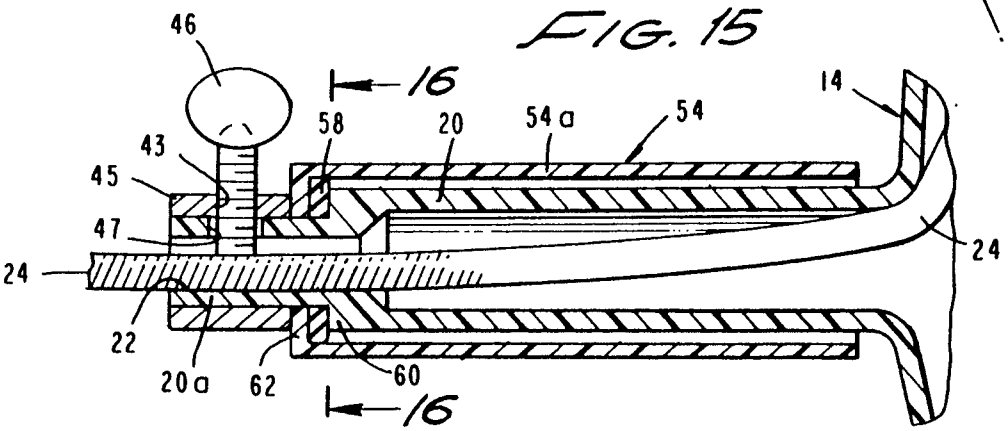
FIG. 15 is a cross-sectional view taken along lines 15—15 of FIG. 14.
Figure 16:
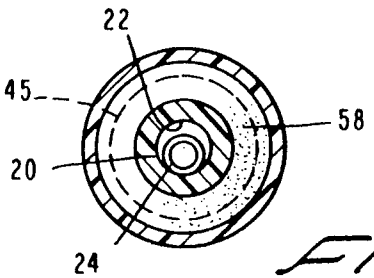
FIG. 16 is a cross-sectional view taken along lines 16—16 of FIG. 15.

Turning now to FIG. 15, feed means are provided for feeding snake 24 outwardly of drum 14. These feed means here comprise snake engagement means shown as a thumb screw which is threadably received within a threaded bore 43 provided in a collar 45 which is positioned over a reduced diameter portion 20*a* of neck 20. The end of thumb screw 46 extends through an aperture 47 provided in neck portion 20 so that as the thumb screw is tightened it will engage snake 24. In this way, as drum 14 is rotated by the crank handle, snake 24 will be controllably fed from the drum through opening 22 provided in neck 20.

Feeding of the snake will continue so long as the snake can travel reasonably freely inwardly of the drain line. However, should the snake encounter an obstruction which cannot be cleared causing the end of the snake to snag in the obstruction, torque forces will immediately start to build up in the snake which will resist continued rotation of drum 14. When this resistance to rotation of the drum reaches a predetermined level, protuberances 42 will disengage from recesses 40 against the urging of compression spring 34. This disengagement of protuberances 42 from recesses 40 is illustrated in FIG. 11.

Figure 11:
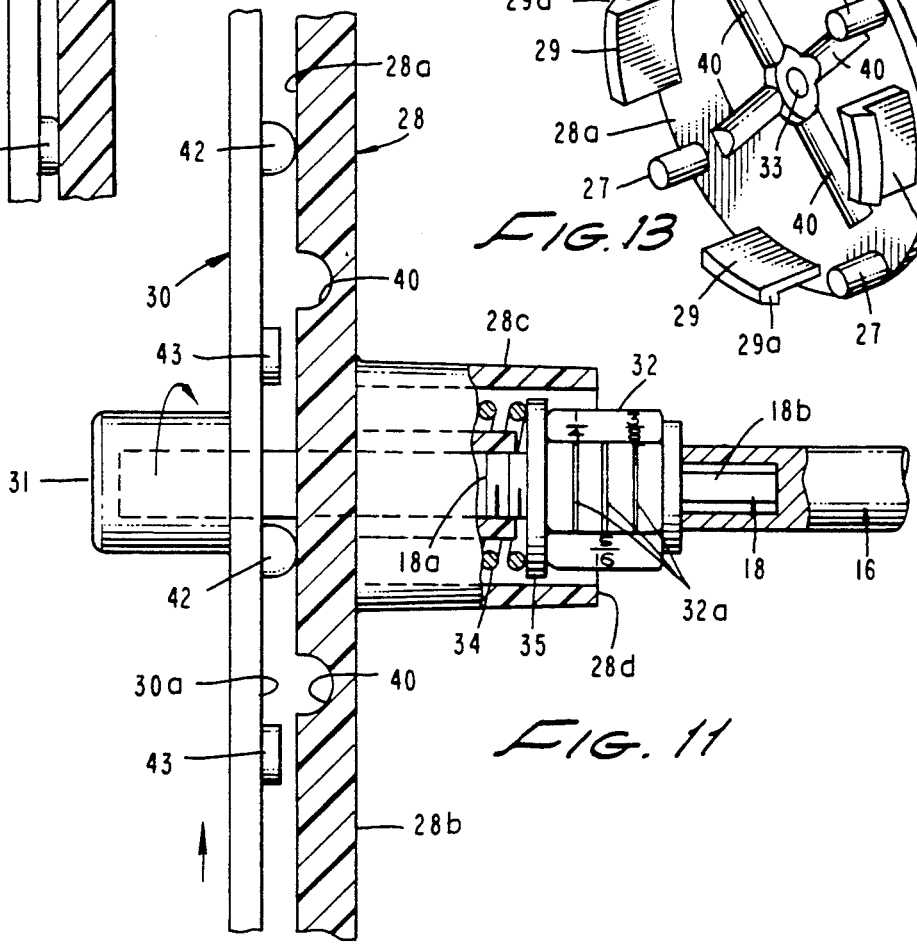
FIG. 11 is a view similar to FIG. 10 but showing the component parts of the torque control mechanism in a second, non-drum rotating, free-wheeling position.

By referring to FIGS. 10 and 11 it can be seen that, under normal drain line cleanout operations, the protuberances remain partially seated with the recesses due to the urging of spring 34. To prevent complete penetration of the protuberances into the recesses, spacers 43 are provided on the inner face of member 30 (FIG. 10) to maintain a spaced relationship between the respective faces of the members. With this construction, upon sufficient predetermined forces being built up tending to resist rotation of drum 14, continued pressure from turning of crank 16 will cause the protuberances 42 to disengage from recesses 40 against the urging of spring 34 and to slide along surface 28*a* of first member 28. With second member 30 thus free wheeling relative to first member 28, drum rotation will cease as will forward feeding of the snake into the drain line. In this way excessive build up of torque in snake 24 will automatically be averted.

Turning particularly to FIG. 10, it is to me noted that nut 32 is provided with indicia 32*a* comprising circumferential lines identified by the fractions ¼, 5/16 and ⅜. These fractions correspond to the diameter of the snakes which can be coiled within drum 14. It is to be noted that when the smallest diameter snake, namely the ¼" diameter snake, is coiled with the drains and the ¼ line is aligned with edge 28*d*, a minimum compression is being exerted on spring 34. This minimum compression results in minimum frictional forces being exerted by second member 30 against first member 28 tending to maintain protuberances 42 within recesses 40. With this arrangement, when the lighter weight snake encounters an obstruction causing torque to build up within the snake, second plate 30 will move into a free wheeling position as shown in FIG. 11 with a minimum force being exerted by snake 42 against free rotation drum 14.

When a larger diameter snake, such as a 5/16" snake is being used, nut 32 is tightened or advanced on shaft 18 so that the indicia corresponding to the 5/16" mark lines up with edge 28*d* of boss 28*c* of second member 28. Advancing nut 32 onto the shaft, of course, increases compressive forces being exerted on spring 34 which results in increased frictional forces being exerted by plate 30 against plate 28 tending to maintain protuberances 42 within recesses 40.

In similar fashion, when nut 32 is further advanced along threaded portion 18*a* of shaft 18 to a position where indicia ⅜" aligns with edge 28*d*, further compressive forces are exerted against spring 34 tending to urge protuberances 42 into greater frictional engaqement with recesses 40. With nut 32 in this advanced position, greater forces by the heavier ⅜" spring resisting rotation of the drum will be required in order for protuberances 42 to disengage from recesses 40.

Figure 14:
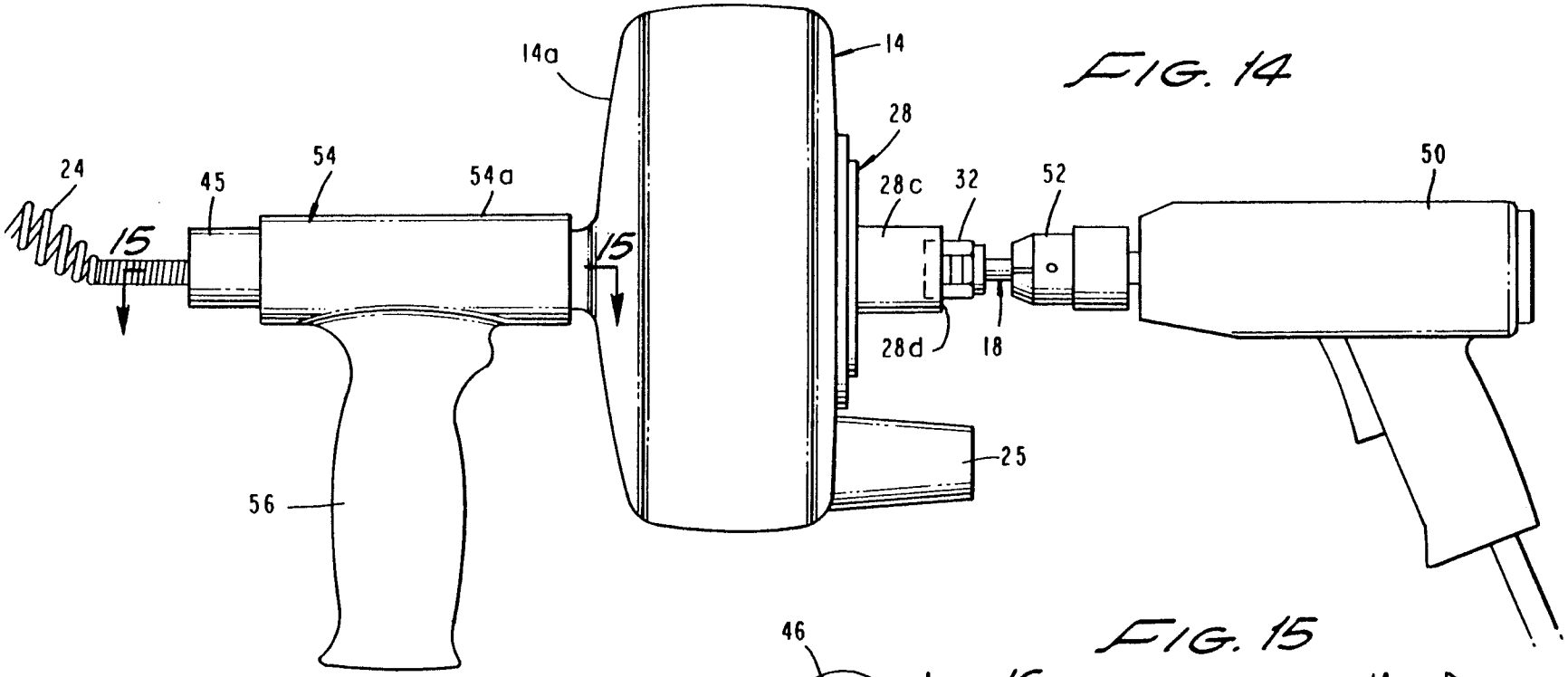
FIG. 14 is a side-elevational view of an alternate form of improved drain clean-out tool.

In the form of the apparatus of the invention shown in FIG. 14, the hand crank driving mechanism has been replaced by an electric drill 50, the chuck 52 of which has been connected to drive shaft 18. Save for drill 50, the rest of the apparatus is the same as previously described and like numerals have been used to identify like components.

When drill 50 comprises a part of the drive means, drum 14 can be driven at much higher speeds of rotation. This causes substantial heating of the neck portion 20 to occur due to its frictional engagement with a forward gripping sleeve 54 having a skirt portion 54*a* which is telescopically received over neck portion 20 (FIG. 15).

In operating the apparatus, the user grips the handle grip 56 which is connected to sleeve 54, inserts the snake into the line to be cleaned, tightens thumb screw 46 and energizes drill 50. This causes drum 14 to rotate rapidly and causes neck portion 20 to rotate rapidly within sleeve 54. To prevent heat build up between the sleeve and neck, a plastic washer 58 is inserted between a shoulder 60 provided on the neck portion and end wall 62 of sleeve 54. Washer 58, which is preferably constructed from Acrylonitrile-butadiene-styrene (ABS), uniquely functions to avoid heat build up and also promotes smooth and free rotation of neck portion 20 within sleeve 54. Experience has shown that without washer 58 being in position between the drain neck and the sleeve, the plastic drain neck will melt and fail after only a few minutes of tool operation.

Having now described the invention in detail in accordance with the requirements of the patent statutes those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A drain cleaning apparatus of the character having an elongated flexible plumbers snake which is insertable into the drain to be cleaned, comprising:

(a) a rotatable drum, including
  (i) a rear wall having an opening;
  (ii) a snake storage portion for closely containing the snake in a coiled configuration; and
  (iii) a forwardly extending neck portion, including an opening adapted to accommodate passage of the snake therethrough;

(b) feed means disposed proximate said opening in said neck portion for feeding the snake progressively inwardly of the drain;

(c) drive means for imparting rotation to said drum; and (d) coupling means disposed intermediate said drum and said drive means for coupling together said drive means and said drum and for rotating said drum only so long as the snake is feeding progressively inwardly of the drain, said coupling means comprising:

(i) a first member connected to said rear wall of said drum, said first member having a face provided with a shaft passageway therethrough in alignment with said opening in said rear wall of said drum;

(ii) a second member connected to said first member, said second member having a face disposed proximate said face of said first member and including a drive shaft extending through said shaft passageway of said first member; and (iii) biasing means associated with said second member for urging said second member into engagement with said first member.

2. A drain cleaning apparatus as defined in claim 1 in which said biasing means is adjustable so as to controllably vary the force tending to urge engagement of said second member with said first member.

3. A drain cleaning apparatus as defined in claim 1 in which one of said faces of said first and second members is provided with a recess and in which the other of said faces is provided with a protuberance receivable within said recess.

4. A drain cleaning apparatus as defined in claim 1 in which said drive means comprises a hand crank connected to said drive shaft.

5. A drain cleaning apparatus as defined in claim 1 in which said drive means comprises a motorized drill connected to said drive shaft.

6. A drain cleaning apparatus of the character having an elongated flexible plumbers snake which is insertable into the drain to be cleaned, comprising:

(a) a rotatable drum, including (i) a rear wall having an opening therein;

(ii) a spring storage portion for closely containing the spring in a coiled configuration; and (iii) a forwardly extending neck portion; including an opening adapted to accommodate passage of the spring therethrough;

(b) snake engaging means disposed proximate said opening in said neck portion for engagement with the snake; and (c) drum rotating means for controllably rotating said drum, comprising;

(i) a first member connected to said rear wall of said drum, said first member having a face provided with a shaft passageway therethrough in alignment with said opening in said rear wall of said drum;

(ii) a second member operably associated with said first member, said second member having a face disposed proximate said face of said first member and including a drive shaft extending through said shaft passageway of said first member, said drive shaft having a threaded shank portion;

(iii) means connected to said drive shaft for urging said second member into frictional engagement with said first member, said means comprising a nut threadably connected to said threaded portion of said drive shaft and a coil spring surrounding said drive shaft and disposed between said nut and said first member; and (iv) drive means for rotating said drive shaft.

7. A drain cleaning apparatus as defined in claim 6 in which said nut exerts a progressively greater compressive force on said spring as said nut advances along said threaded portion of said drive shaft, whereby said second member is urged with progressively greater force into engagement with said first member.

8. A drain cleaning apparatus as defined in claim 6 in which said face of said first member is provided with circumferentially spaced recesses and in which said face of said second member is provided with circumferentially spaced protuberances receivable within said recesses.

9. A drain cleaning apparatus of the character having an elongated flexible plumbers snake which is insertable into the drain to be cleaned, comprising:

(a) a rotatable drum, including:

(i) a rear wall having an opening therein;

(ii) a spring storage portion for closely containing the spring in a coiled configuration; and (iii) a forwardly extending neck portion; including an opening adapted to accommodate passage of the spring therethrough;

(b) snake engaging means disposed proximate said opening in said neck portion for engagement with the snake; and (c) drum rotating means for controllably rotating said drum, comprising:

(i) a first generally disc shaped member removably connected to said rear wall of said drum proximate said opening therein, said member having a central opening therethrough, inner and outer faces and a centrally disposed, outwardly extending, tubular shaped boss terminating in an edge;

(ii) a second generally disk shaped member connected to said first member, said second member having a face disposed proximate said inner face of said first member and including an outwardly extending drive shaft having a threaded portion;

(iii) a connector means for interconnecting said first and second members and for urging said face of said second member into frictional engaqement with said first face of said first member said connector means comprising a nut threadably connectable to said threaded portion of said drive shaft and a coil spring disposed intermediate said nut and said second surface of said first member; and (iv) drive means for rotating said drive shaft of said second member.

10. A drain cleaning apparatus as defined in claim 9 in which said face of said first member is provided with circumferentially spaced recesses and in which said face of said second member is provided with circumferentially spaced protuberances receivable within said recesses.

11. A drain cleaning apparatus as defined in claim 10 in which said face of said second member is provided with a plurality of spacers for engagement with said inner face of said first member to maintain a spaced relationship between said face of said second member and said interface of said first member.

12. A drain cleaning apparatus as defined in claim 10 in which said nut is provided with indicia alienable with said edge of said tubular shaped boss as said nut is advanced along said threaded portion of said drive shaft.

13. A drain cleaning apparatus of the character having an elongated flexible plumbers snake which is insertable into the drain to be cleaned, comprising:

(a) a rotatable drum, including:

(i) a rear wall having an opening therein;

(ii) a spring storage portion for closely containing the spring in a coiled configuration; and (iii) a forwardly extending plastic neck portion; including an opening adapted to accommodate passage of the spring therethrough and a circumferentially extending shoulder disposed proximate said opening;

(b) gripping means for gripping the apparatus comprising:

(i) a tubular element including a skirt portion surrounding said plastic neck portion, said skirt portion terminating in an end wall having an opening therein for closely receiving said neck portion of said plastic neck;

(ii) a plastic washer circumscribing said plastic neck and located intermediate said end wall of said skirt portion and said circumferentially extending shoulder of said plastic neck portion;

(iii) a handle portion connected to said skirt portion;

(c) drive means for rotating said drum;

(d) feed means carried by said first portion of said neck for feeding the snake progressively inwardly of the drain; and (e) coupling means disposed intermediate drum and said drive means for coupling together said drive means and said drum and for rotating said drum so long as the snake is feeding progressively inwardly of the drain, said coupling means comprising:

(i) a first member connected to said rear wall of said drum, said first member having a face provided with a shaft passageway therethrough in alignment with said opening in said rear wall of said drum;

(ii) a second member connected to said first member, and including a drive shaft extending through said shaft passageway of said first member; and (iii) biasing means associated with said second member for urging said second member into engagement with said first member.

14. A drain cleaning apparatus as defined in claim 13 in which said plastic neck includes a first reduced diameter portion and a second enlarged diameter portion, said shoulder being located at the junction of said first and second portions.

15. A drain cleaning apparatus as defined in claim 14 in which said washer is constructed from Acrylonitrile-butadiene-styrene.

* * * * *